US009261305B2

(12) United States Patent
Tunzi

(10) Patent No.: US 9,261,305 B2
(45) Date of Patent: Feb. 16, 2016

(54) SHELVING ASSEMBLY FOR REFRIGERATOR COMPARTMENT

(71) Applicant: Whirlpool Corporation, Benton Harbor, MI (US)

(72) Inventor: Todd Tunzi, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/788,418

(22) Filed: Mar. 7, 2013

(65) Prior Publication Data

US 2014/0252939 A1 Sep. 11, 2014

(51) Int. Cl.
*F25D 25/02* (2006.01)
*A47B 57/08* (2006.01)

(52) U.S. Cl.
CPC ..... *F25D 25/02* (2013.01); *A47B 57/08* (2013.01); *Y10T 29/49826* (2015.01)

(58) Field of Classification Search
CPC . F25D 23/065; F25D 2325/021; F25D 25/02; A47B 57/06; A47B 57/08
USPC ..... 312/408; 108/107–108, 110; 248/244, 248/246; 211/187, 193, 207
See application file for complete search history.

(56) References Cited

U.S. PATENT DOCUMENTS 391,438 A * 10/1888 Van Horm ..... 248/244
569,640 A * 10/1896 Hartzell ..... 248/244
3,865,337 A * 2/1975 Towfigh et al. ..... 248/246
4,250,815 A * 2/1981 Swanson ..... 108/108
4,901,965 A * 2/1990 Bowman ..... 248/246
5,004,302 A * 4/1991 Stocking et al. ..... 312/408
5,034,861 A 7/1991 Sklenak et al.
5,279,231 A * 1/1994 Kolvites et al. ..... 108/107
5,287,252 A * 2/1994 Caruso ..... 362/92
5,361,599 A 11/1994 Dasher
6,065,821 A 5/2000 Anderson et al.
6,105,233 A * 8/2000 Neal ..... 29/451
6,584,916 B1 * 7/2003 Felton et al. ..... 108/107
6,675,725 B2 * 1/2004 Felton et al. ..... 108/107
6,813,896 B1 * 11/2004 Janke et al. ..... 62/126
6,817,688 B2 11/2004 O'Halloran
7,007,905 B2 * 3/2006 Roberts ..... 248/250
7,429,091 B2 * 9/2008 Reed et al. ..... 312/408
7,434,951 B2 * 10/2008 Bienick ..... 362/92
7,472,876 B2 * 1/2009 Jones ..... 248/242
7,748,806 B2 * 7/2010 Egan ..... 312/408
7,840,286 B2 11/2010 Caldwell et al.
7,954,797 B2 6/2011 Sasahara
8,038,112 B2 * 10/2011 Kluge ..... 248/244
8,123,315 B2 * 2/2012 Hagele et al. ..... 312/408
8,282,178 B2 10/2012 Bradley et al.

(Continued)

*Primary Examiner* — Hanh V Tran

(57) ABSTRACT

A shelving assembly includes ladder rails mounted within spaced elongated pockets formed in the rear wall of a refrigerator compartment. Each ladder rail presents a front, side, rear wall portions. Adjacent the front wall portion, a vertical slot is defined, at least in part, by an in-turned portion of the front wall portion. Offset from the slot, the in-turned portion is formed with a plurality of vertically spaced and rearwardly projecting hooks. Each shelf of the assembly includes arms, each having an anchoring pin and a support foot. In mounting the shelf, the support foot and the anchoring pin of each arm are placed through a cutout formed in the front wall portion of a respective ladder, the shelf is arranged in a desired vertical position with the arm sliding within the slot, and then the anchoring pin is supported upon a respective one of the hooks.

20 Claims, 8 Drawing Sheets

(56) References Cited

U.S. PATENT DOCUMENTS

| | | | | |
|---|---|---|---|---|
| 2004/0255607 | A1* | 12/2004 | Barmann et al. | 62/407 |
| 2005/0204966 | A1* | 9/2005 | Bienick et al. | 108/108 |
| 2006/0163985 | A1* | 7/2006 | Blersch et al. | 312/408 |
| 2007/0262220 | A1* | 11/2007 | Kluge | 248/246 |
| 2008/0030114 | A1* | 2/2008 | Becke | 312/408 |
| 2008/0043456 | A1* | 2/2008 | Bernardini et al. | 362/94 |
| 2009/0115302 | A1* | 5/2009 | Benz et al. | 312/408 |
| 2010/0133970 | A1* | 6/2010 | Shin et al. | 312/408 |
| 2010/0270251 | A1* | 10/2010 | Mejac | 211/134 |
| 2011/0164399 | A1 | 7/2011 | Driver | |
| 2012/0043874 | A1* | 2/2012 | Simpson et al. | 312/408 |

* cited by examiner

SHELVING ASSEMBLY FOR REFRIGERATOR COMPARTMENT

BACKGROUND OF THE INVENTION

1. Field of the Invention

The present invention pertains to the art of refrigerators and, more particularly, to a shelving assembly used to support vertically adjustable shelves in a compartment of a refrigerator.

2. Description of the Related Art

In the art of refrigerators, it is widely known to employ a plurality of shelves and compartments, including drawers and bins, to store a wide range of food products. In the case of shelves, in order to accommodate varying sized food items to be stored, many different types of shelving systems have been proposed, including shelving assemblies that will enable shelves to be supported at heights that can be varied as desired. Vertically adjustable shelving arrangements for refrigerators typically employ shelf ladders fixedly secured to and projecting from the rear wall of a refrigerator compartment for removably securing hooks of shelf supporting brackets. Current ladder designs can employ about thirty to forty rectangular openings or slots stamped into each one of a pair of spaced elongated steel bars. Overall, the bars with the visual holes can be considered visually unappealing.

SUMMARY OF THE INVENTION

The present invention is directed to a refrigerator shelving assembly which enables various shelves to be supported from ladder rails which are mounted within spaced elongated pockets formed in the rear wall of a compartment of the refrigerator. Each ladder rail presents a front wall portion, a side wall portion, a rear wall portion and, adjacent the front wall portion, a vertical slot which is visible from the front of the refrigerator compartment. The slot is defined, at least in part, by an in-turned portion of the front wall portion. Offset from the slot, behind the front wall portion and spaced forward of the rear wall portion of the ladder rail, the in-turned portion is formed with a plurality of vertically spaced and rearwardly projecting hooks. The hooks are exposed to a receiving zone established within the ladder rail, with the front wall portion including at least one cutout opening into the receiving zone.

Each shelf of the assembly includes arms which interact with the ladder rails to retain the shelves at selected vertical positions with the refrigerator compartment. More specifically, each arm includes an anchoring pin and a support foot. In mounting the shelf, the support foot and the anchoring pin on each arm is positioned within a respective receiving zone by way of one of the cutout openings, while the arm extends through the slot. Once in the receiving zone, the shelf can be freely, vertically adjusted. After a desired vertical mounting position is selected, the anchoring pin is shifted into a position wherein the anchoring pin is retained on a selected hook, while the support foot abuts the rear wall portion of the ladder rail.

With the above arrangement, a fully adjustable, yet aesthetically pleasing, shelving assembly is established. In accordance with other aspects of the invention, visual indicator lines are provided along the front wall portion to reflect the positioning of the hooks and delineate the potential positions for the shelf. In addition, one or more ladder rails cooperate with the support foot to provide power to a lighting arrangement incorporated into the shelf. In any case, additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
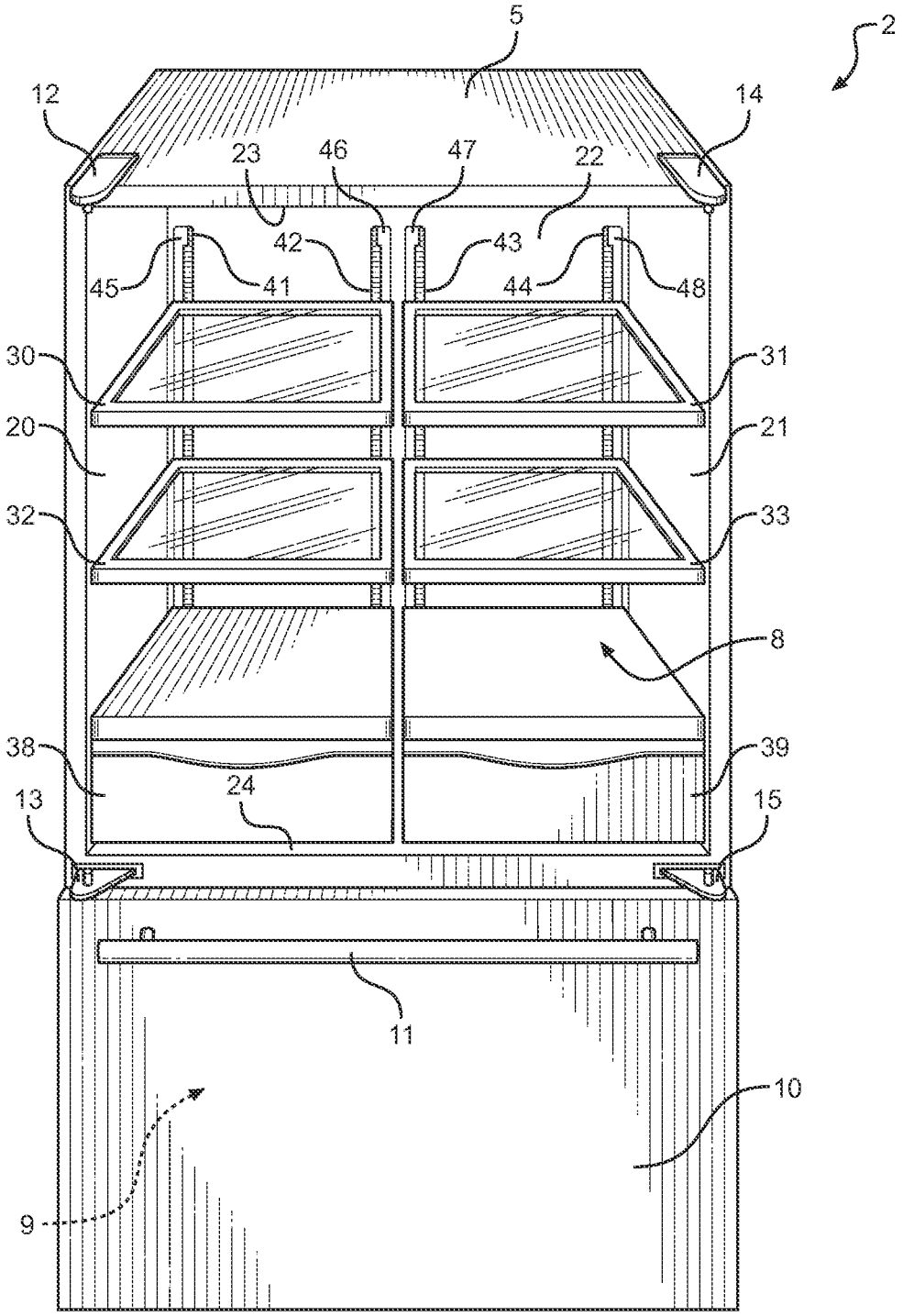
FIG. 1 is a front view of a refrigerator provided with a shelving assembly constructed in accordance with the present invention.

With initial reference to FIG. 1, a refrigerator associated with the present invention is generally indicated at 2. As shown, refrigerator 2 includes a cabinet 5 within which is defined an upper fresh food compartment 8 and a lower freezer compartment 9 located behind a freezer door 10 having a handle 11. Also depicted are pairs of upper and lower hinges 12, 13 and 14, 15 which are used in connection with pivotally mounting French-style upper fresh food compartment doors of refrigerator 2, with the fresh food compartment doors not being shown in order to illustrate internal components of refrigerator 2. Compartment 8 is defined by a liner (not separately labeled) positioned in cabinet 5, with the liner including opposing side walls 20 and 21, a rear wall 22, a top wall 23 and a bottom wall 24. In the embodiment shown, compartment 8 includes a plurality of spaced shelves 30-33, as well as a plurality of storage drawers 38 and 39. More importantly, the present invention is particularly directed to the construction and mounting of one or more of shelves 30-33 through the use of ladder rails 41-44 mounted in pockets 45-48 formed in rear wall 22 as will be detailed more fully below. However, at this point, it should be realized that, although refrigerator 2 is shown to constitute a bottom mount style refrigerator, the invention is equally applicable to other refrigerator styles, including top mount and side-by-side units.

In general, ladder rails 41 and 43 are identically constructed, while ladder rails 42 and 44 are also identically constructed and mirror images of ladder rails 41 and 43. Therefore, a detailed description of ladder rail 42 will be presented with reference to FIGS. 2A and 2B and it is to be understood that corresponding structure exists for ladder rails 41, 43 and 44. As shown, ladder rail 42 includes a front wall portion 52, a side wall portion 54, a rear wall portion 56 and a side flange portion 58. Front wall portion 52 includes an in-turned portion 60 which is spaced from side flange portion 58 by a fore-to-aft gap 64. In addition, in-turned portion 60 is laterally offset from side flange portion 58 in order to establish a vertical slot 66.

Offset from vertical slot 66, behind front wall portion 52 and spaced forward of rear wall portion 56 of ladder rail 38, in-turned portion 60 is formed with a plurality of vertically spaced and rearwardly projecting hooks, one of which is indicated at 72. Each hook 72 defines an arcuate notch 77 and extends towards rear wall portion 56 into receiving zone 78. As also depicted in these figures, front wall portion 52 is provided with an upper opening or cutout 80 for reasons which will be detailed more fully below. Front wall portion 52 can actually be provided with additional vertically spaced cutouts, such as exemplified by cutout 82. At this point, it should simply be recognized that each cutout 82, 82 opens into receiving zone 78. Finally, rear wall portion 56 of ladder rail 38 includes a mounting tab 85 shown to project above a height of front wall portion 52.

Figure 3A:
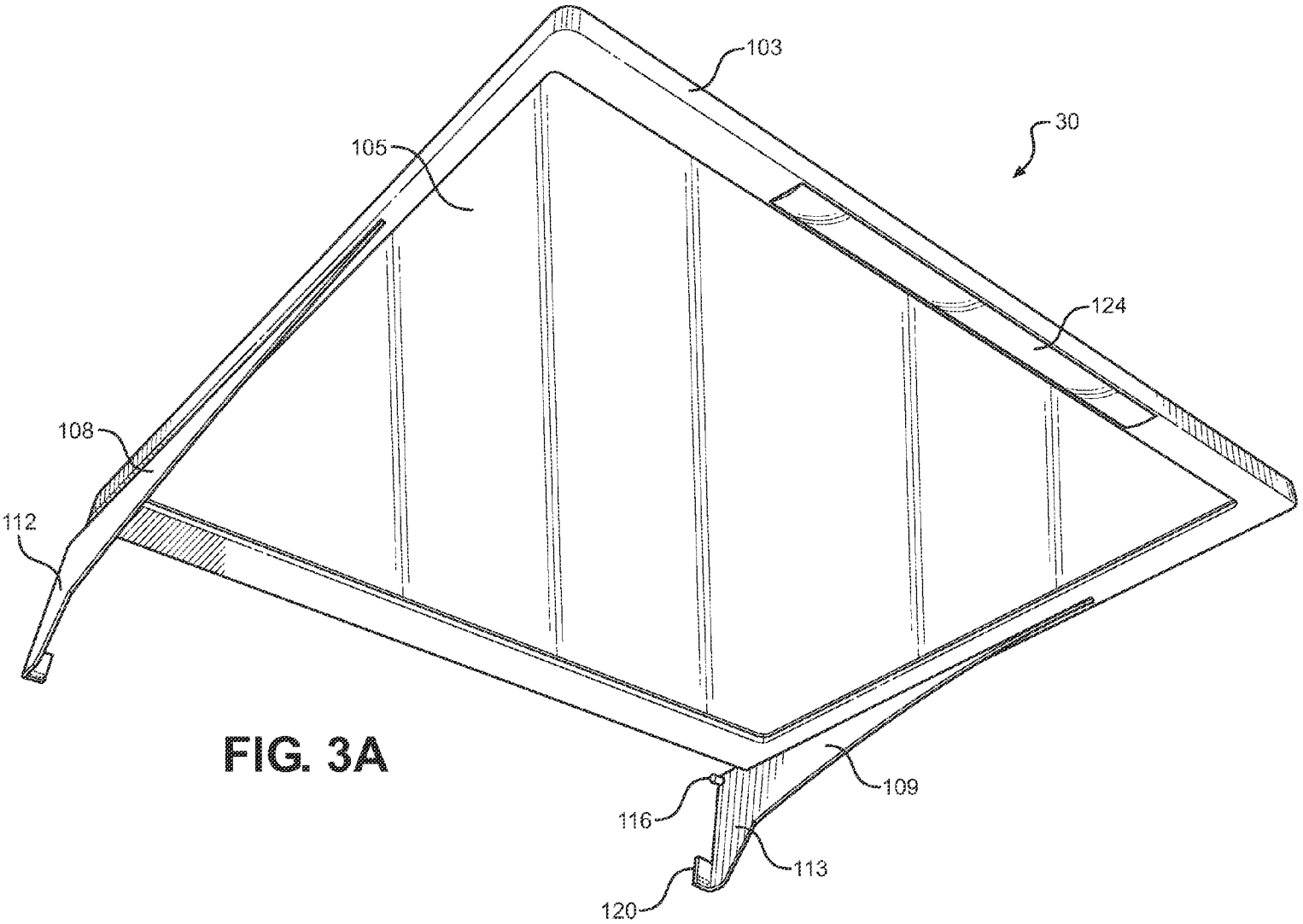
FIG. 3A is a lower perspective view of a shelf of the shelving assembly.
Figure 3B:
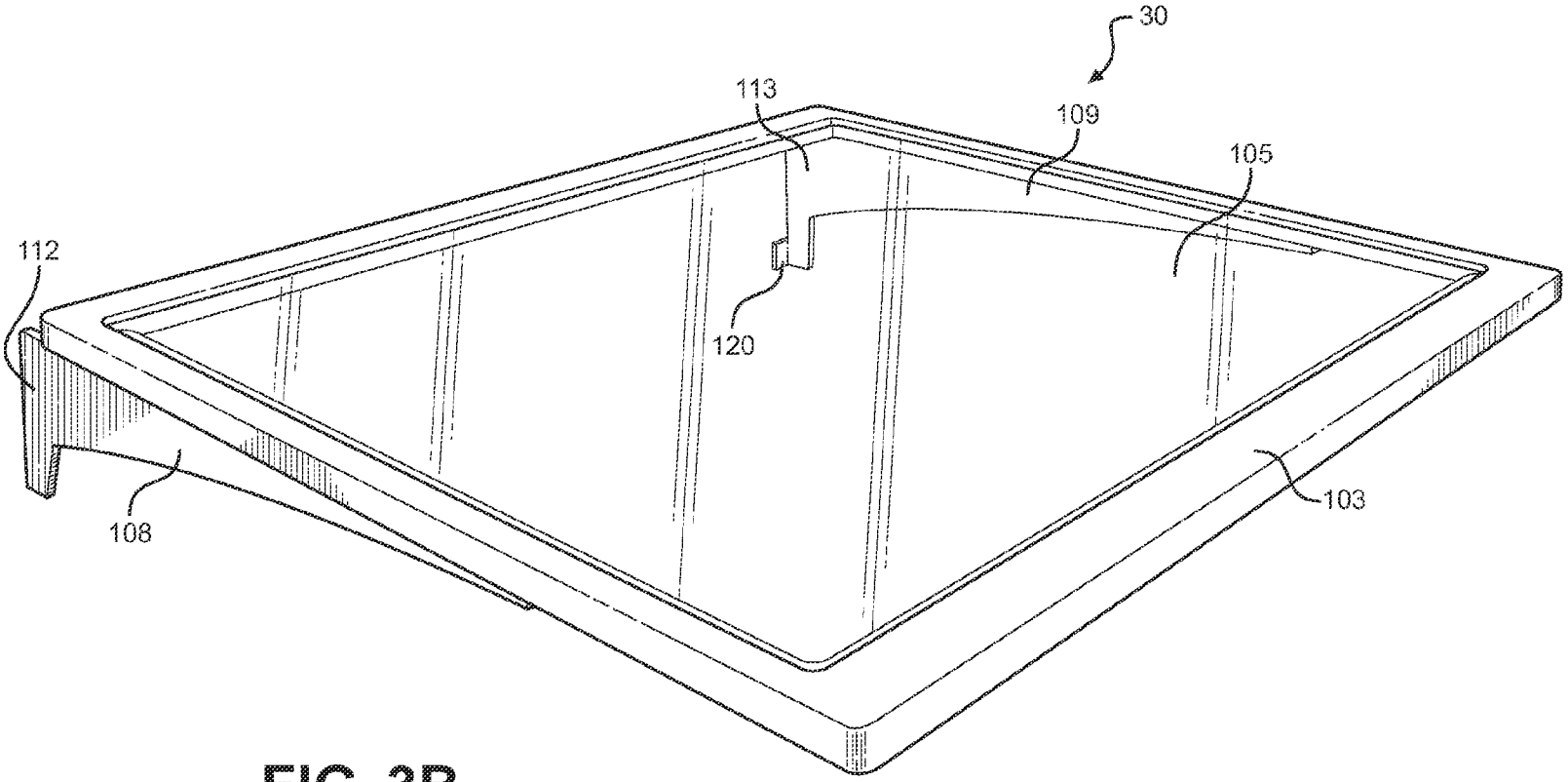
FIG. 3B is an upper perspective view of the shelf of FIG. 3A.

Reference will now be made to FIGS. 3A and 3B in describing details of shelves 30-33. Much like ladder rails 41-44, shelves 30-33 are illustrated to be identically constructed such that a detailed description of shelf 30 will now be provided with reference to these figures and it is to be understood that additional identically or similarly constructed shelves can also be provided within fresh food compartment 8. As illustrated, shelf 30 constitutes a half-shelf, i.e., the shelf extends approximately half the width of compartment 8, and includes a peripheral rim 103 which encapsulates a platform 105 shown to be made of glass. Shelf 30 also includes a pair of side brackets 108 and 109 which terminate in rearwardly projecting arms 112 and 113 respectively. Each arm 112, 113 is provided with an inwardly extending, upper anchoring member or pin 116 and an inwardly extending, lower support foot 120. At this point, it should be recognized that the shelves constructed in accordance with the present invention can actually take various forms and be made from a wide range of materials. In the embodiment shown, peripheral rim 103 is constituted by plastic which is molded around glass platform 105 and integrated with metal side brackets 108 and 109. However, as will become more fully evident below, an important design detail of shelves 30-33 in accordance with the invention is concentrated on the structure of arms 112 and 113, rather than the remainder of each shelf 30-33. As also shown in FIG. 3A, shelf 30 incorporates a lighting unit 124 depicted as being provided along a lower front portion (not separately labeled) of peripheral rim 103.

Figure 4B:
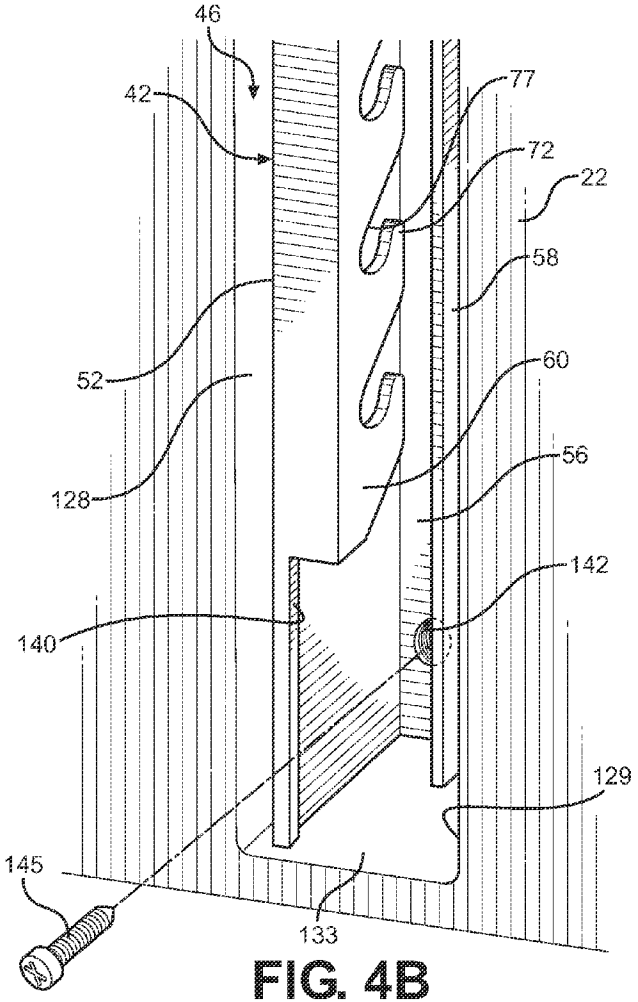
FIG. 4B illustrates a further mounting stage for the ladder rail in a pocket formed in the rear wall of the refrigerator of FIG. 1.
Figure 4A:
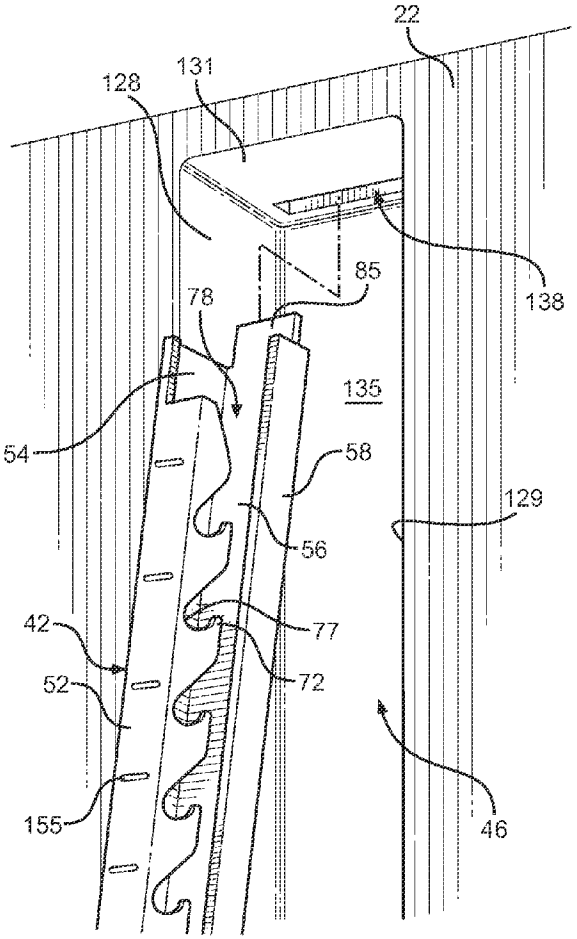
FIG. 4A illustrates an initial mounting stage for the ladder rail in a pocket formed in the rear wall of the refrigerator of FIG. 1.

FIGS. 4A and 4B provide additional details of pockets 45-47, as well as illustrate the manner in which a respective ladder rail 41-44 is mounted therein. For exemplary purposes, these figures detail the construction of pocket 46 in receiving ladder rail 42. As shown, pocket 46 includes pocket side walls 128 and 129, a top wall 131, a bottom wall 133, and a back wall 135. Formed in top wall 131 adjacent back wall 135 is a recess 138. In mounting ladder rail 42 within pocket 46, mounting tab 85 is initially inserted into recess 138 and then ladder rail 42 is pivoted to be fully received within pocket 46. Although various configurations are possible, a preferred embodiment of the invention positions ladder rail 42 within pocket 46 such that front wall portion 52 is either flush with, or spaced behind, rear wall 22. As shown in FIG. 4B, ladder rail 42 includes a lower cutout region 140 which provides access to a through hole 142 formed in rear wall portion 56. In combination with mounting tab 85 being received in recess 138, a mechanical fastener 145 is received within through hole 142 and threadably secures ladder rail 42 in position.

Figure 5:
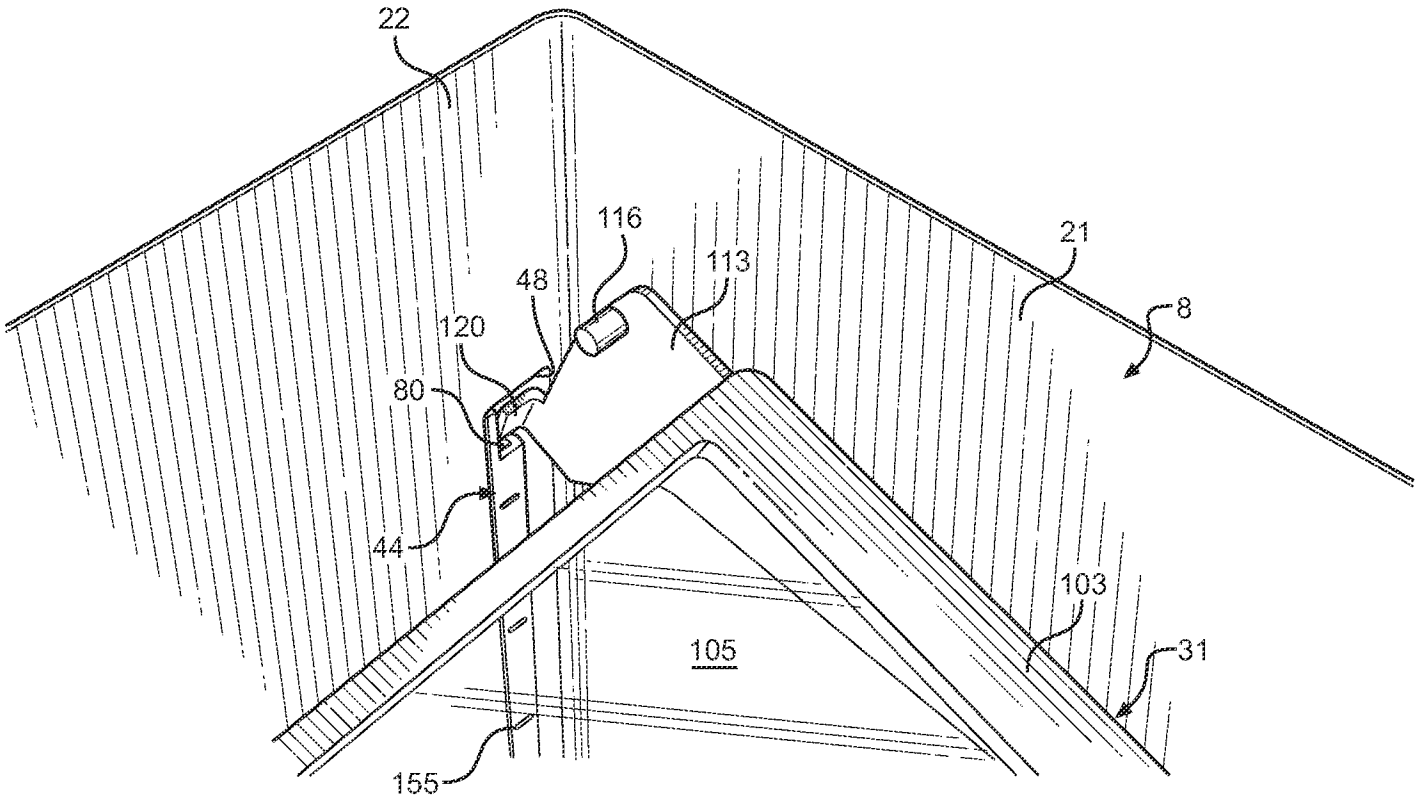
FIG. 5 illustrates the shelf of the invention being initially interengaged with the ladder rail.
Figure 6:
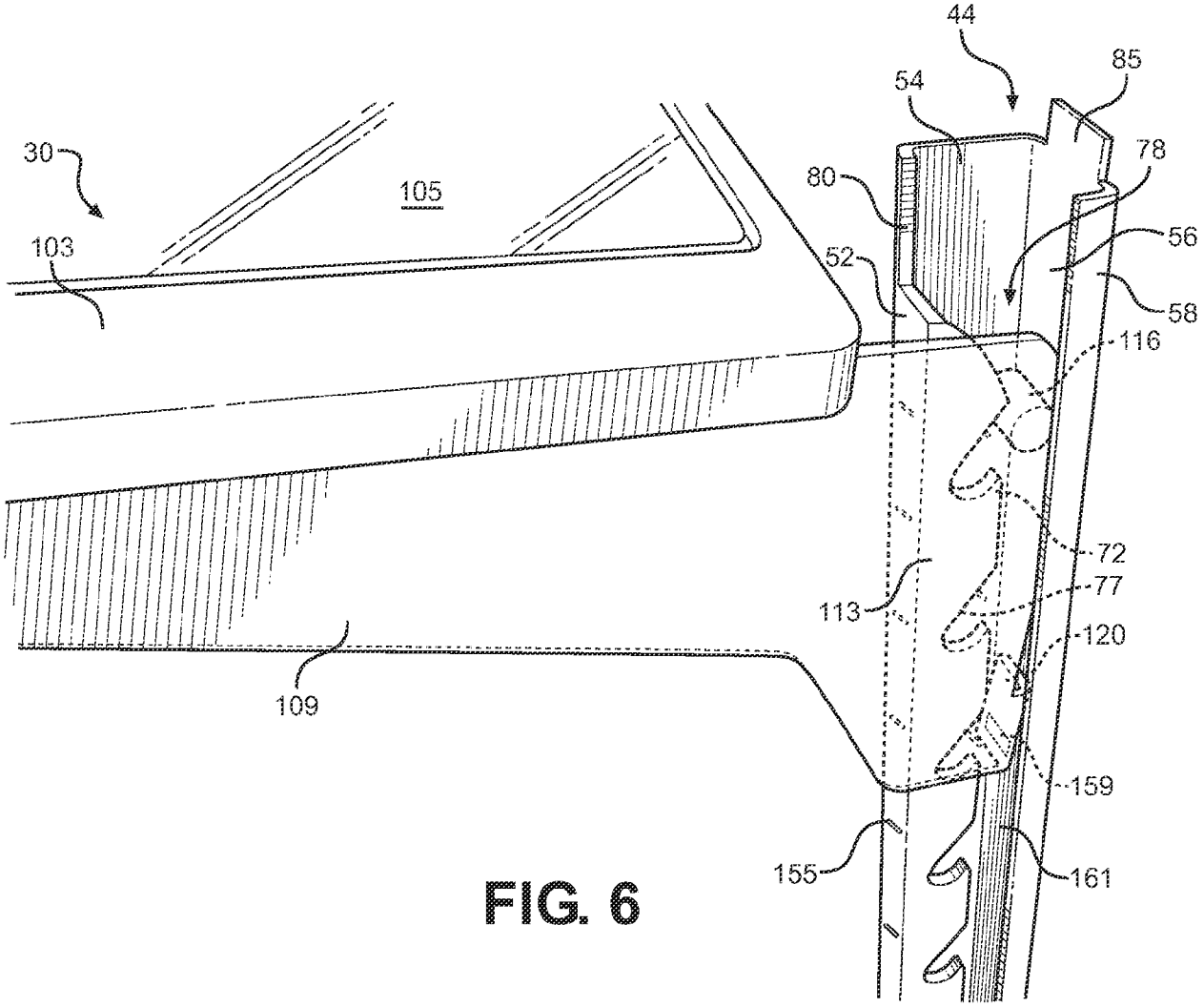
FIG. 6 is a partially side view illustrating the shelf interengaged with the ladder rail while assuming an adjusting position.
Figure 7:
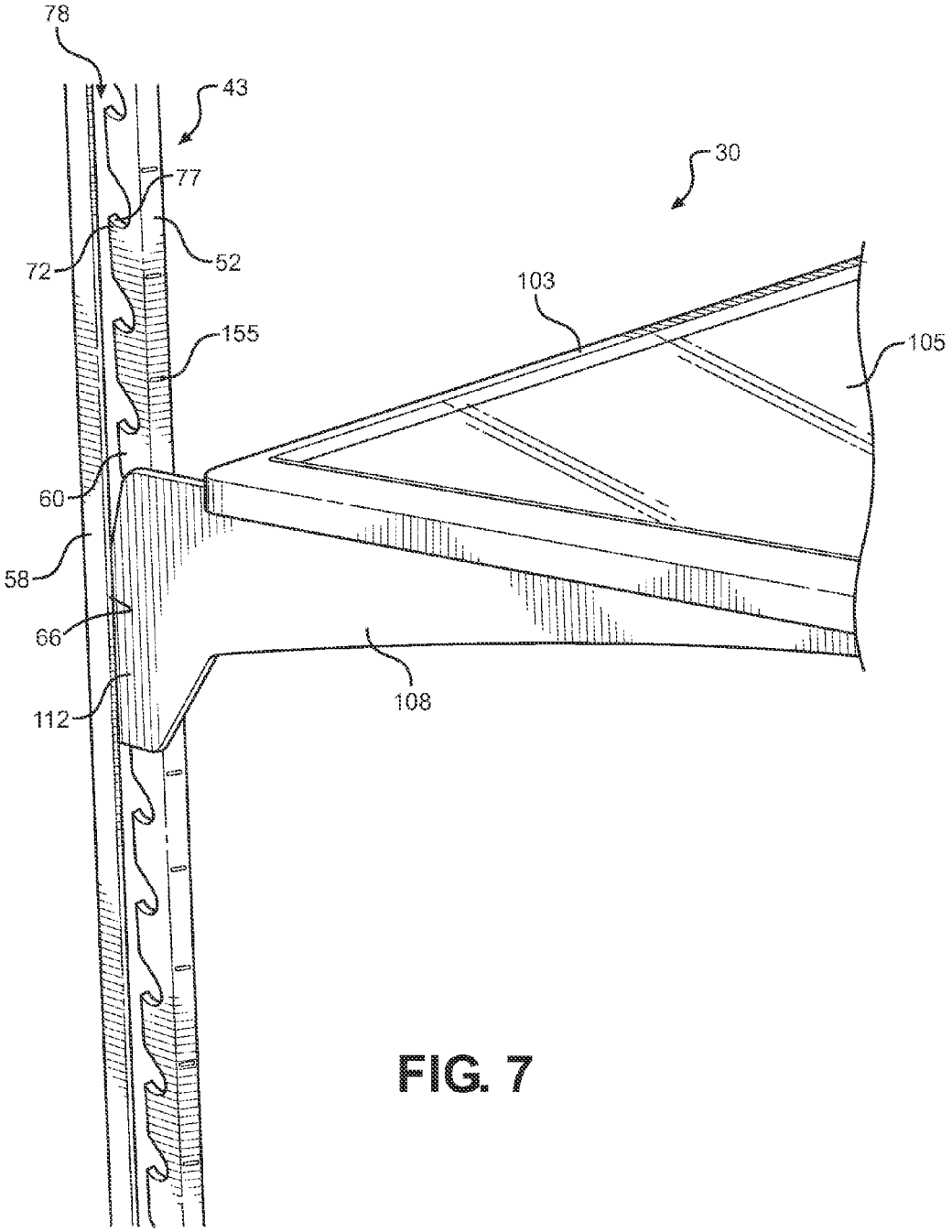
FIG. 7 illustrates the shelf in a final mounting position.

Reference will now be made to FIGS. 5-7 in describing the manner in which shelf 31 is supported at a select vertical position upon ladder rails 43 and 44 within compartment 8. With initial reference to FIG. 5, during initial assembly, support foot 120 is positioned within cutout 80. In this manner, support foot 120 is arranged within receiving zone 78. By moving support foot 120 downward within receiving zone 78, anchor pin 116 can also extend through cutout 80 into receiving zone 78 while arm 113 extends through vertical slot 66 so as to be directly adjacent in-turned portion 60, with in-turned portion 60 on one side of arm 113 and side flange portion 58 being on the other side of arm 113 as perhaps best shown in FIG. 6. With both anchoring pin 116 and support foot 120 positioned rearward of in-turned portion 60, shelf 31 can be vertically repositioned within compartment 8, while being guided through the vertical movement. Once a desired vertical height for shelf 31 is selected, shelf 31 is tilted such that anchoring pin 116 is received within a respective notch 77 of an associated hook 72. At this point, anchoring pin 116 establishes a pivot axis for shelf 31 about which peripheral rim 103 and platform 105 can pivot downward until support foot 120 abuts rear wall portion 56, whereupon platform 105 assumes a substantially horizontal configuration as shown in FIGS. 1 and 7.

Figure 2A:
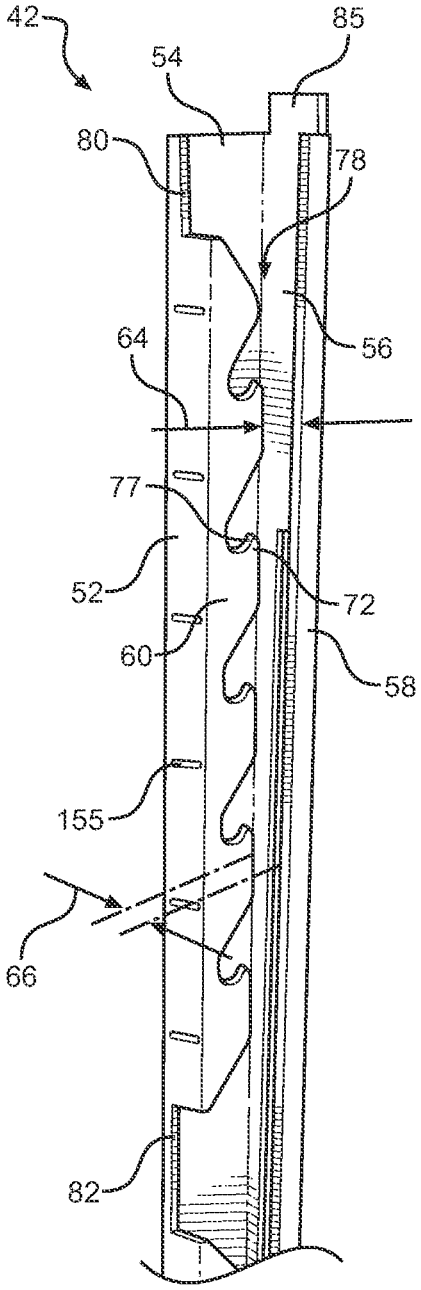
FIG. 2A is a front perspective view of a ladder rail of the shelving assembly.
Figure 2B:
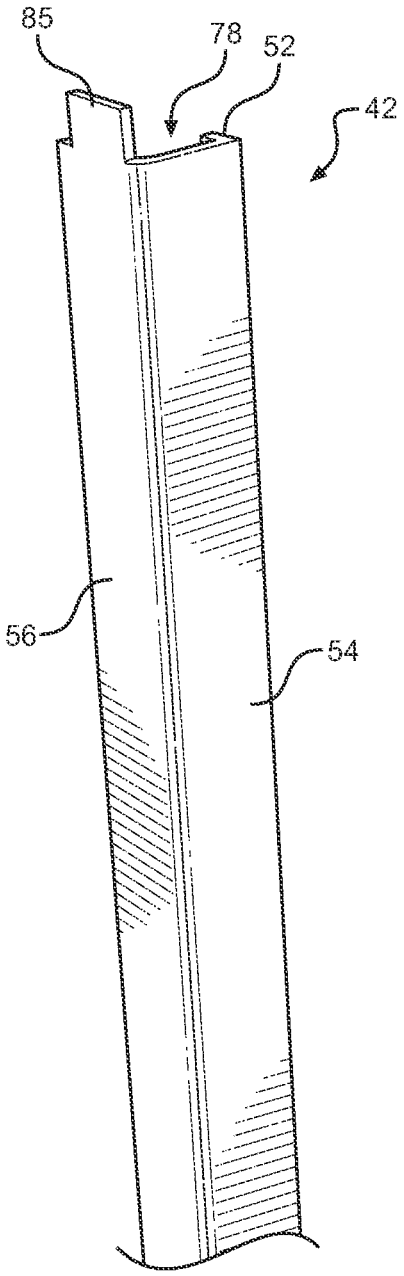
FIG. 2B is a rear perspective view of the ladder rail of FIG. 2.

With the above configuration, it should be readily apparent that hooks 72 are not visible from a front view of compartment 8. Instead, with ladder rails 41-44 being located in pockets 45-48 and ladder rails 41-44 being configured as described above, it is only apparent that arms 112 and 113 extend from respective vertical slots 66. The loading of shelves 30-33 with food items merely enhances the rigidity of the mounting configuration by further retaining each anchoring pin 116 in the notch 77 of a selected hook 72. Still, each shelf 30-33 can be readily, vertically adjusted by simply lifting and angling the shelf 30-33 backwards, slidably repositioning the shelf with anchoring pin 116 being within receiving zone 78 and spaced from hooks 72 as discussed above with reference to FIG. 6, and then reengaging anchoring pin 116 with another hook 72. Since hooks 72 are not visually apparent, the front wall portion 52 of each ladder rail 41-44 is shown to include various visual indicator lines, such as indicated at 155 in FIGS. 2A, 4A and 5-7 to assist a user in locating a desired mounting position. With the inclusion of one or more additional cutouts, such as cutout 82 in front wall portion 52 as shown in FIG. 2A, a given shelf 30-33 can be readily attached to or removed from respective ladder rails 41-44 at different vertical height positions.

In accordance with the embodiment wherein one or more of shelves 30-33 includes a lighting unit, such as lighting unit 124, it is preferred to transfer power to lighting unit 124 through this overall rail mounting arrangement. To this end, FIG. 6 illustrates the inclusion of an electrical contact 159 provided on a back surface (not separately labeled) of support foot 120 which comes into contact with a power strip 161 mounted on rear wall portion 56. Although not shown, wires or other electrical conducting members are provided as part of shelf 31 to provide electricity between contact 159 and lighting unit 124.

Although described with reference to preferred embodiments of the invention, it should be readily understood that various changes and/or modifications can be made to the invention without departing from the spirit thereof. For instance, while four laterally spaced pockets are presented in the illustrated embodiment, it should be recognized that only two pockets need be employed for shelves extending across the entire width of the compartment and, even in the case of half-shelves, the center two pockets could be combined by forming one larger pocket. In general, the invention is only intended to be limited by the scope of the following claims.

What is claimed is:

1. A refrigerator comprising:

a cabinet within which is established a refrigerated compartment defined by a rear wall and side walls, said rear wall being formed with a plurality of spaced elongated pockets, with each of the pockets being defined by pocket side walls interconnected by a back wall;

a plurality of ladder rails, each of the ladder rails being mounted in a respective one of the pockets and including a front wall portion, a rear wall portion and a side wall portion interconnecting the front wall portion and the rear wall portion, a distal edge section of the front wall portion being turned inward from a remainder of the front wall portion so as to project toward, yet spaced from, the rear wall portion, the distal edge section defining an in-turned portion that is formed integrally with the front wall portion, with the in-turned portion being spaced from a respective one of the pocket walls, on a lateral side opposite the side wall portion, to establish a slot and being provided with a plurality of vertically spaced and rearwardly projecting hooks; and a shelf mounted upon the plurality of ladder rails within the refrigerated compartment, said shelf including laterally spaced and rearwardly projecting arms with each arm including an anchoring pin, said shelf being supported by the ladder rails in a select vertical position within the refrigerated compartment with the anchoring pin of each arm being retained on a select one of the hooks and the arm projecting through a respective said slot at a lateral position offset from both the anchoring pin and the in-turned portion.

2. The refrigerator according to claim 1, wherein the front wall portion and the rear wall portion of each ladder rail are spaced by the side wall portion such that the front wall portion, the rear wall portion, the side wall portion and the in-turned portion define a receiving zone into which the anchoring pin projects.

3. The refrigerator according to claim 2, wherein each arm further includes a support foot which is positioned in the receiving zone and abuts the rear wall portion of the ladder rail to further support the shelf within the refrigerated compartment.

4. The refrigerator according to claim 3, further comprising: a light provided on the shelf, with the light being powered through an electrical contact established between the support foot and the rear wall portion of the ladder rail.

5. The refrigerator according to claim 2, further comprising: at least one cutout provided in the front wall portion of each ladder rail and opening into the receiving zone for positioning the anchoring pin in the receiving zone.

6. The refrigerator according to claim 1, further comprising:

a recess formed in one of the pocket walls; and a tab projecting from the ladder rail, each ladder rail being mounted in a respective pocket with the tab projecting into the recess.

7. The refrigerator according to claim 1, further comprising: a plurality of vertically spaced visual indicator lines provided on the front wall portion of at least one of the plurality of ladder rails, with the visual indicator lines reflecting the positioning of the hooks and delineating potential mounting positions for the shelf.

8. The refrigerator according to claim 1, wherein the front wall portion of each ladder rail is mounted in the respective pocket without extending forward of the rear wall of the refrigerated compartment.

9. A refrigerator comprising:

a cabinet within which is established a refrigerated compartment defined, at least in part, by a rear wall;

a plurality of ladder rails spaced along the rear wall of the refrigerated compartment, each of the ladder rails including a front wall portion, a rear wall portion and a side wall portion, a distal edge section of the front wall portion being turned inward from a remainder of the front wall portion so as to project toward the rear wall portion, the distal edge section defining an in-turned portion that is formed integrally with the front wall portion, the side wall portion interconnecting and maintaining a spacing between the front and rear wall portions such that a receiving zone is established within each said ladder rail, with the front wall portion being formed with at least one cutout opening to the receiving zone and the in-turned portion being provided with a plurality of vertically spaced and rearwardly projecting hooks which are spaced from the rear wall portion; and a plurality of shelves for mounting upon the plurality of ladder rails within the refrigerated compartment, each shelf including laterally spaced and rearwardly projecting arms with each arm including an anchoring member, said shelf being configured to be supported by the ladder rails in a select vertical position within the refrigerated compartment with the anchoring member of each arm being introduced into the receiving zone through the at least one cutout and retained on a select one of the hooks while the arm projects from the ladder rail directly adjacent, but offset from, the in-turned portion, on a lateral side opposite the side wall portion.

10. The refrigerator according to claim 9, further comprising: a plurality of spaced elongated pockets formed in the rear wall, wherein each of the pockets is defined by pocket side walls interconnected by a back wall and wherein each of the ladder rails is mounted in a respective one of the pockets.

11. The refrigerator according to claim 10, further comprising:

a recess formed in one of the pocket walls; and a tab projecting from the ladder rail, each ladder rail being mounted in a respective said pocket with the tab projecting into the recess.

12. The refrigerator according to claim 10, wherein a vertical slot is established between the in-turned portion and one of the pocket side walls through which a respective said arm projects.

13. The refrigerator according to claim 10, wherein the front wall portion of each ladder rail is mounted in the respective one of the pockets without extending forward of the rear wall of the refrigerated compartment.

14. The refrigerator according to claim 9, wherein each arm further includes a support foot which is positioned in the receiving zone through the at least one cutout and abuts the rear wall portion of the ladder rail to further support the shelf within the refrigerated compartment.

15. The refrigerator according to claim 14, further comprising: a light provided on the shelf, with the light being powered through an electrical contact established between the support foot and the rear wall portion of the ladder rail.

16. The refrigerator according to claim 9, further comprising: a plurality of vertically spaced visual indicator lines provided on the front wall portion of at least one of the plurality of ladder rails, with the visual indicator lines reflecting the positioning of the hooks and delineating potential mounting positions for the shelf.

17. A method of mounting a shelf within a refrigerated compartment of a refrigerator comprising:

mounting a plurality of ladder rails within respective pockets formed in a rear wall of the refrigerated compartment such that a front wall portion of the ladder rail is visually apparent from a front of the refrigerated compartment while an in-turned portion formed integrally with the front wall portion of the ladder rail extends within the pocket and behind the front wall portion, wherein a side wall portion of the ladder rail interconnects the front wall portion with a rear wall portion of the ladder rail, a distal edge section of the front wall portion being turned inward from a remainder of the front wall portion so as to project toward, yet spaced from, the rear wall portion, the distal edge section defining the in-turned portion, with the in-turned portion being spaced from a pocket side wall of the pocket, on a lateral side opposite the side wall portion, to establish a slot;

inserting an anchoring member projecting from an arm of a shelf into a receiving zone of a respective one of the plurality of ladder rails, with the arm projecting from the ladder rail through the slot, the slot extending directly adjacent, but laterally offset from, both the anchoring member and the in-turned portion;

shifting the shelf vertically relative to the plurality of ladder rails in order to locate the shelf in a desired vertical position within the refrigerated compartment; and positioning the anchoring member upon a selected one of a plurality of vertically spaced hooks projecting rearwardly from the in-turned portion to mount the shelf for use in supporting food items within the refrigerated compartment.

18. The method of claim 17, wherein mounting each of the plurality of ladder rails within the pockets includes positioning a tab projecting from the rear wall portion of the ladder rail into a recess formed in a pocket wall of a respective one of the pockets.

19. The method of claim 17, further comprising:

inserting a support foot projecting from the arm into the receiving zone prior to inserting the anchoring member projecting from the arm into the receiving zone; and mounting the shelf within the refrigerated compartment by also abutting the support foot with the rear wall portion of the ladder rail.

20. The method of claim 17, further comprising: locating the shelf relative to the selected one of a plurality of vertically spaced hooks through a respective one of a plurality of vertically spaced visual indicator lines provided on the front wall portion of at least one of the plurality of ladder rails, with the visual indicator lines reflecting the positioning of the hooks and delineating potential mounting positions for the shelf.

* * * * *